US008174484B2

(12) United States Patent
Lee et al.

(10) Patent No.: US 8,174,484 B2
(45) Date of Patent: May 8, 2012

(54) SIGNAL PROCESSING CIRCUIT AND METHOD

(75) Inventors: Ting-Chi Lee, Xindian (TW); Wen-Liang Liu, Dali (TW); Chun-Hsiung Chen, Hsinchu (TW)

(73) Assignees: Holtek Semiconductor Inc., Hsinchu (TW); Signal Electronic Co., Ltd., Taipei (TW)

( * ) Notice: Subject to any disclaimer, the term of this patent is extended or adjusted under 35 U.S.C. 154(b) by 870 days.

(21) Appl. No.: 12/239,970

(22) Filed: Sep. 29, 2008

(65) Prior Publication Data

US 2009/0160835 A1 Jun. 25, 2009

(30) Foreign Application Priority Data

Dec. 21, 2007 (TW) ..... 96149522 A

(51) Int. Cl.
*G09G 3/36* (2006.01)

(52) U.S. Cl. ..... 345/102; 345/87; 345/204; 345/690; 345/691

(58) Field of Classification Search ..... 345/55, 345/76, 78, 82, 83, 87, 88, 102, 204, 690, 345/691; 315/169.1, 169.2, 169.3, 169.4
See application file for complete search history.

(56) References Cited

U.S. PATENT DOCUMENTS 6,894,463 B2 * 5/2005 Kernahan ..... 323/267
6,909,266 B2 * 6/2005 Kernahan et al. ..... 323/282
6,946,753 B2 * 9/2005 Kernahan et al. ..... 307/151

* cited by examiner

*Primary Examiner* — My-Chau T Tran
(74) *Attorney, Agent, or Firm* — Volpe and Koenig, P.C.

(57) ABSTRACT

A signal processing method is provided and includes the following steps. A first synchronizing signal having a synchronizing frequency and a next expected pulse with an expected rising edge is provided. A second synchronizing signal having a selected frequency being within a frequency range is produced when the synchronizing frequency of the first synchronizing signal is out of a frequency range. A third synchronizing signal having a first pulse with a first rising edge is produced when the synchronizing frequency is within the frequency range, wherein the first rising edge is produced at an expected time point. Whether the next expected pulse appears in a period from the expected time point to a certain time point is detected as a detecting result. And a first falling edge of the first pulse is produced based on the detecting result. A picture-field flicker phenomenon of an LCD is eliminated through the method.

20 Claims, 5 Drawing Sheets

SIGNAL PROCESSING CIRCUIT AND METHOD

FIELD OF THE INVENTION

The present invention relates to a signal processing circuit and method, and more particularly to a circuit and method for suppressing the ripple-stripe phenomenon related to a cold cathode fluorescent lamp (CCFL).

BACKGROUND OF THE INVENTION

In general, a CCFL is used to serve the panel of a liquid crystal display (LCD). The ground level can be caused to fluctuate at the moment when the CCFL is lighted. When the fluctuation of the ground level is further synchronized with a synchronizing signal, the voltage of the LCD can be caused to be unstable, so that the ripple-stripe phenomenon easily appears.

The synchronizing signal is a control signal and is also a trigger signal. It may be a pulse signal and may also be either a sine wave or an irregular pulse signal. A control signal is referred to the synchronizing signal as long as it can make the frequency or the phase of the controlled device reach a coincidence and can make the controlled device change with the predetermined schedule.

In the prior art, a method avoiding the ripple-stripe phenomenon is that the lighting frequency of the CCFL is synchronized with the frequency of the synchronizing signal of the LCD. Although this processing method using the illusion of the vision solves the ripple-stripe problem, yet another problem is derived therefrom; i.e.; in internal processing, the synchronizing signal of some of LCD control integrated circuits can delay a pulse. FIG. 1(*a*) shows a conventional synchronizing signal used to drive a driving integrated circuit of a CCFL of an LCDTV. The display frequency of the picture fields of the LCDTV is 60 Hz (or 50 Hz), and the lighting frequency of the CCFL is 48.5 KHz, wherein the lighting frequency is controlled by the frequency of the synchronizing signal $V_{SYN}$. As one period being a reciprocal of the frequency 60 Hz (or 50 Hz) cannot just accommodate complete cycles of pulses having the frequency 48.5 KHz, the synchronizing signal of some of the LCD control integrated circuits can delay a pulse.

Please refer to FIG. 1(*b*), which is a schematic diagram showing conventional waveforms including a synchronizing signal $V_{SYNC}$ of an LCD and a lamp current $I_{CCFL}$, corresponding to the synchronizing signal $V_{SYNC}$, of a CCFL. As shown, when a pulse of the synchronizing signal $V_{SYNC}$ is lost due to delay, a pulse, corresponding to the lost pulse, of the lighting signal of the CCFL also disappear. Therefore, both the lamp voltage and the lamp current $I_{CCFL}$ of the CCFL are lowered, which makes the ripple-stripe or the picture-field flicker phenomenon.

How to solve the picture-field flicker phenomenon, caused due to a pulse delayed in the synchronizing signal, by an effective and brief circuit becomes the primary motive of the present invention.

SUMMARY OF THE INVENTION

It is an object of the present invention to provide a signal processing circuit and method. A first synchronizing signal is received and is used to produce a second synchronizing signal driving a CCFL, wherein the second synchronizing signal supplements the lost pulse of the first synchronizing signal for eliminating the picture-field flicker phenomenon of the LCD.

It is therefore an aspect of the present invention to provide the signal processing method including the following steps. A frequency range is defined. A first synchronizing signal having a synchronizing frequency and a next expected pulse with an expected rising edge is provided. A second synchronizing signal having a selected frequency being within the frequency range is produced when the synchronizing frequency of the first synchronizing signal is out of the frequency range. A third synchronizing signal having a first pulse with a first rising edge is produced when the synchronizing frequency is within the frequency range, wherein the first rising edge is produced at an expected time point at which the expected rising edge is expected to be produced. Whether the next expected pulse appears in a period from the expected time point to a certain time point is detected as a detecting result when the synchronizing frequency is within the frequency range. And a first falling edge of the first pulse is produced based on the detecting result.

It is therefore another aspect of the present invention to provide the signal processing circuit including an external trigger interrupt generator, a timer, a programmable pulse generator, and a control unit. The external trigger interrupt generator receives a first synchronizing signal, and detects a pulse edge of the first synchronizing signal for determining whether the first synchronizing signal appears, wherein the first synchronizing signal has a next expected pulse with an expected rising edge. The programmable pulse generator has a prescale adjustment value, and produces a second synchronizing signal having a first pulse with a first rising edge according to the prescale adjustment value. The control unit is coupled to the external trigger interrupt generator, the timer and the programmable pulse generator, wherein the control unit utilizes the external trigger interrupt generator and the timer for allowing the programmable pulse generator to produce the first rising edge at an expected time point at which the expected rising edge is expected to be produced.

BRIEF DESCRIPTION OF THE DRAWINGS

The foregoing and other features and advantages of the present invention will be more clearly understood through the following descriptions with reference to the drawings, wherein:

FIG. 1(*b*) is a schematic diagram showing conventional waveforms including a synchronizing signal of an LCD and a lamp current, corresponding to the synchronizing signal, of a CCFL;

FIG. 3(*b*) is a schematic diagram showing waveforms when a next expected pulse of the signal processing circuit does not appear according to the first embodiment of the present invention;

DETAIL DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Figure 1A:
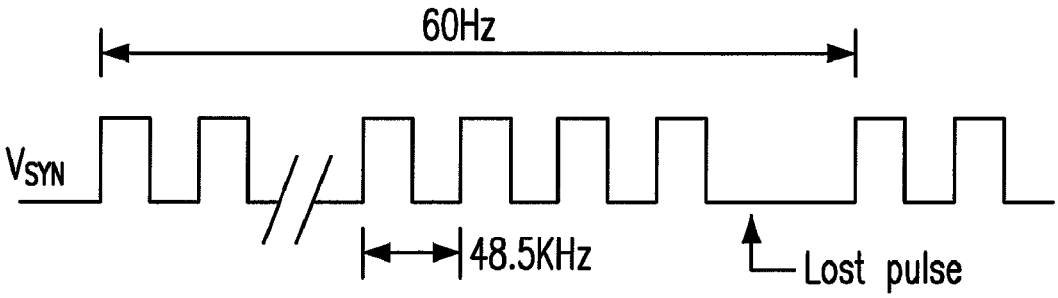
Fig. 1(a)(PRIOR ART)
FIG. 1(*a*) is a schematic diagram showing a conventional synchronizing signal used to drive a driving integrated circuit of a CCFL of an LCDTV.
Figure 1B:
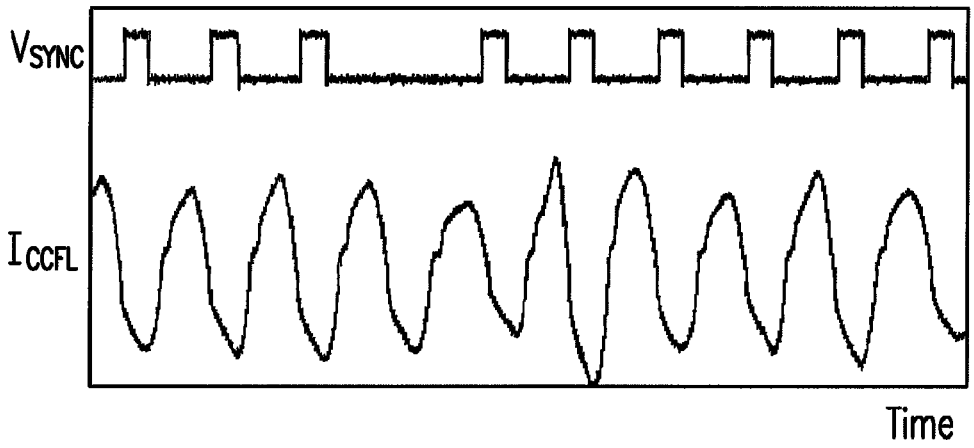
Fig. 1(b)(PRIOR ART)
Figure 2:
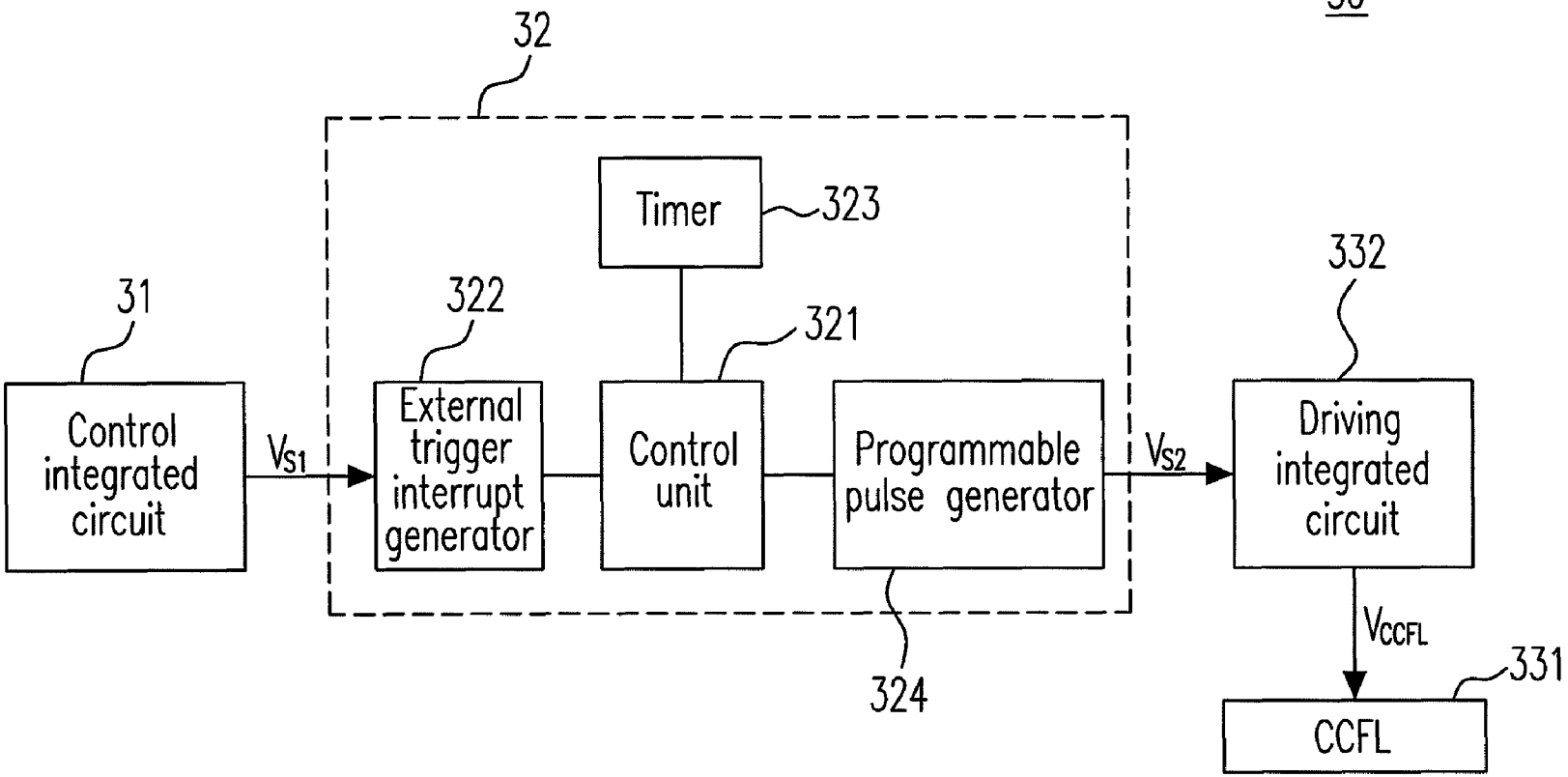
FIG. 2 is a schematic diagram showing an application system of a signal processing circuit according to the first embodiment of the present invention.

Please refer to FIG. 2, which is a schematic diagram showing an application system of a signal processing circuit according to the first embodiment of the present invention. As shown, the application system 30 of the signal processing circuit 32 includes a control integrated circuit 31 of an LCD, the signal processing circuit 32, a CCFL 331, and a driving integrated circuit 332 of the CCFL 331.

A synchronizing signal $V_{S1}$ produced by the control integrated circuit 31 is used to control the synchronization displaying picture fields of the LCD and serves as a preliminary signal controlling the CCFL 331. The signal processing circuit 32 receives the synchronizing signal $V_{S1}$ and adjusting the synchronizing signal $V_{S1}$ for producing a synchronizing signal $V_{S2}$. The driving integrated circuit 331 of the CCFL 331 receives the synchronizing signal $V_{S2}$ for producing a lamp voltage signal $V_{CCFL}$ lighting the CCFL, wherein a frequency of the synchronizing signal $V_{S2}$ is used as a lighting frequency of the CCFL. Besides, the synchronizing signal $V_{S2}$ may also be provided to a driving integrated circuit (Not shown) of a back light source including a light emitting diode (LED).

The signal processing circuit 32 includes an external trigger interrupt generator 322, a timer 323, a programmable pulse generator 324, and a control unit 321. The signal processing circuit 32 may be, e.g., a microcontroller or an application specific integrated circuit. The external trigger interrupt generator 322 receives the synchronizing signal $V_{S1}$ and detects edges of the synchronizing signal $V_{S1}$ for producing interrupt triggers to be provided to the control unit 321, wherein the synchronizing signal $V_{S1}$ has a series of pulses, and the external trigger interrupt generator 322 is designed to make that it can detects a rising or a falling edge or one of the rising or the falling edge of the synchronizing signal $V_{S1}$.

The programmable pulse generator 324 having a prescale adjustment value produces a synchronizing signal $V_{S2}$ according to the prescale adjustment value, wherein the prescale adjustment value is used to control pulse widths of the synchronizing signal $V_{S2}$. The control unit 321 is coupled to the external trigger interrupt generator 322, the timer 323, and the programmable pulse generator 324 and controls the operation of the external trigger interrupt generator 322, the timer 323, and the programmable pulse generator 324. If the signal processing circuit 32 is a microcontroller, the operation of the control unit 321 may be represented by a firmware, wherein the firmware controls the operation of the external trigger interrupt generator 322, the timer 323, and the programmable pulse generator 324 through instructions.

The external trigger interrupt generator 322 receives the synchronizing signal $V_{S1}$ including a series of the pulses, and it is not sure whether a next expected pulse of the synchronizing signal $V_{S1}$ can appear. No matter whether the next expected pulse of the synchronizing signal $V_{S1}$ appears, the signal processing circuit 32 must ensure that a first pulse, corresponding to the next expected pulse, produced in the synchronizing signal $V_{S2}$ can appear.

Figure 3A:
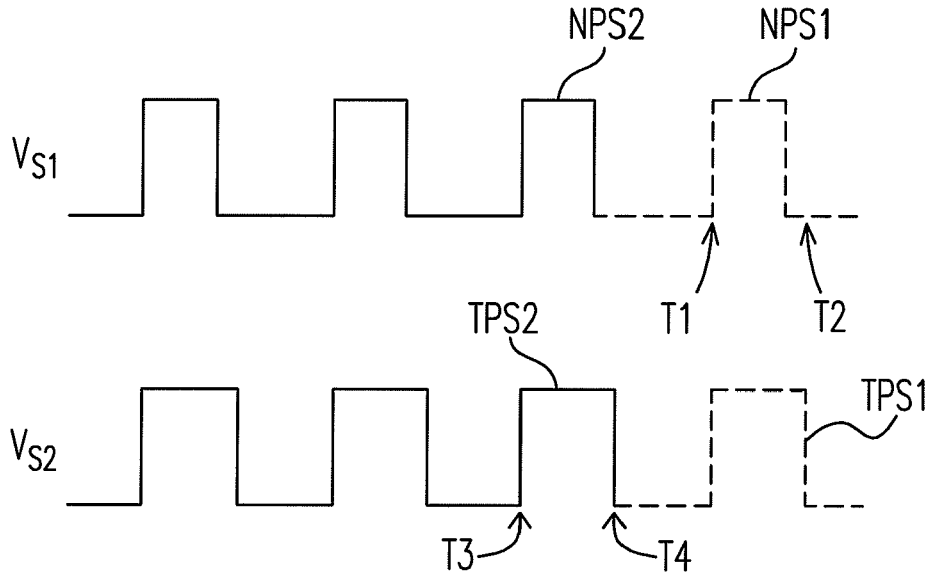
FIG. 3(*a*) is a schematic diagram showing waveforms when a next expected pulse of the signal processing circuit appears according to the first embodiment of the present invention.
Figure 3B:
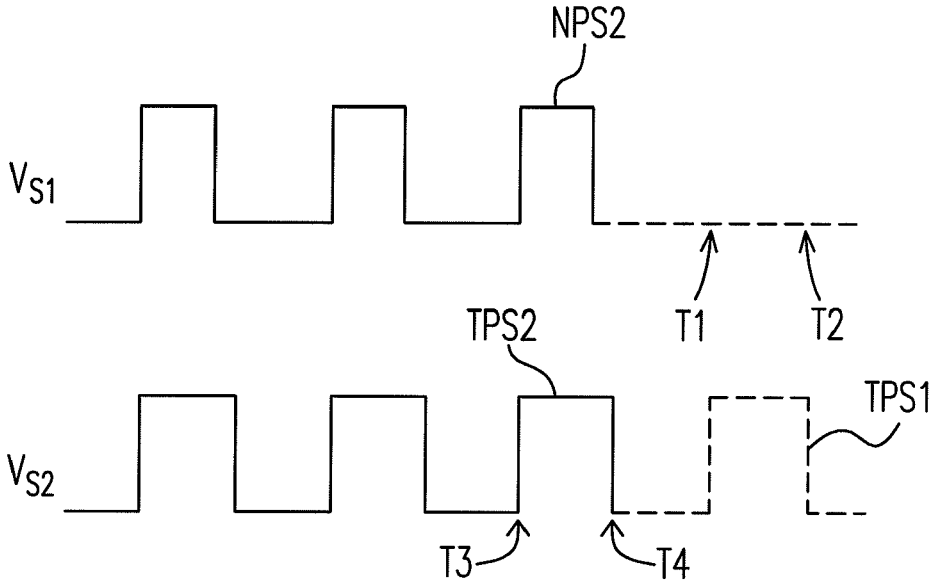

Please refer to FIG. 3(*a*) and FIG. 3(*b*). FIG. 3(*a*) is a schematic diagram showing waveforms when a next expected pulse of the signal processing circuit appears according to the first embodiment of the present invention. FIG. 3(*b*) is a schematic diagram showing waveforms when a next expected pulse of the signal processing circuit does not appear according to the first embodiment of the present invention. The control unit 321 utilizes the external trigger interrupt generator 322 and the timer 323 to analyze periods of a set of previous pulses just before the next expected pulse NPS1 of the synchronizing signal $V_{S1}$ for obtaining an average pulse width, a synchronizing period, and a synchronizing frequency, wherein the synchronizing period is a reciprocal of the synchronizing frequency. The synchronizing signal $V_{S2}$ has a second pulse TPS2 being a pulse right before a first pulse TPS1 corresponding to the next expected pulse NPS1, and an expected rising-edge time point T1 of the next expected pulse NPS1 is later or about later for the synchronizing period than a rising-edge time T3 of the second pulse TPS2; i.e., the expected rising-edge time point T1 is a summation or about a summation of the rising-edge time T3 and the synchronizing period. The expected rising-edge time point T1 can also be calculated from the average pulse width, the synchronizing period, and a rising-edge time or a falling-edge time of the last pulse NPS2 of the synchronizing signal $V_{S1}$.

The control unit 321 utilizes the external trigger interrupt generator 322 and the timer 323 for allowing the programmable pulse generator 324 to produce a rising edge of the first pulse TPS1, corresponding to the next expected pulse NPS1, of the synchronizing signal $V_{S2}$ at the expected rising-edge time point T1 at which the expected rising edge is expected to be produced.

The control unit 321 utilizes the external trigger interrupt generator 322 and the timer 323 to detect whether the next expected pulse NPS1 appears in a period from the expected rising-edge time point T1 to a certain time point T2 as a detecting result, and the programmable pulse generator 324 produces a falling edge of the first pulse TPS1 based on the detecting result. Therein the certain time point T2 is a half of the synchronizing period later than the expected rising-edge time point T1, or the certain time point T2 is a multiple of a half of the synchronizing period later than the expected rising-edge time point T1 and the multiple is about 1 in general.

When an expected falling edge of the next expected pulse NPS1 appears before the certain time point T2, the control unit 321 utilizes the programmable pulse generator 324 to produce the falling edge of the first pulse TPS1 at a moment or a predetermined time after the expected falling edge of the next expected pulse NPS1. When the expected falling edge of the next expected pulse NPS1 does not appear before the certain time point T2, the control unit 321 utilizes the programmable pulse generator 324 to produce the falling edge of the first pulse TPS1 at a moment or a predetermined time after the certain time point T2. The control unit 321 controls the falling-edge time point of the first pulse TPS1 by adjusting the prescale adjustment value of the programmable pulse generator 324 for adjusting the pulse width of the first pulse TPS1.

Figure 4:
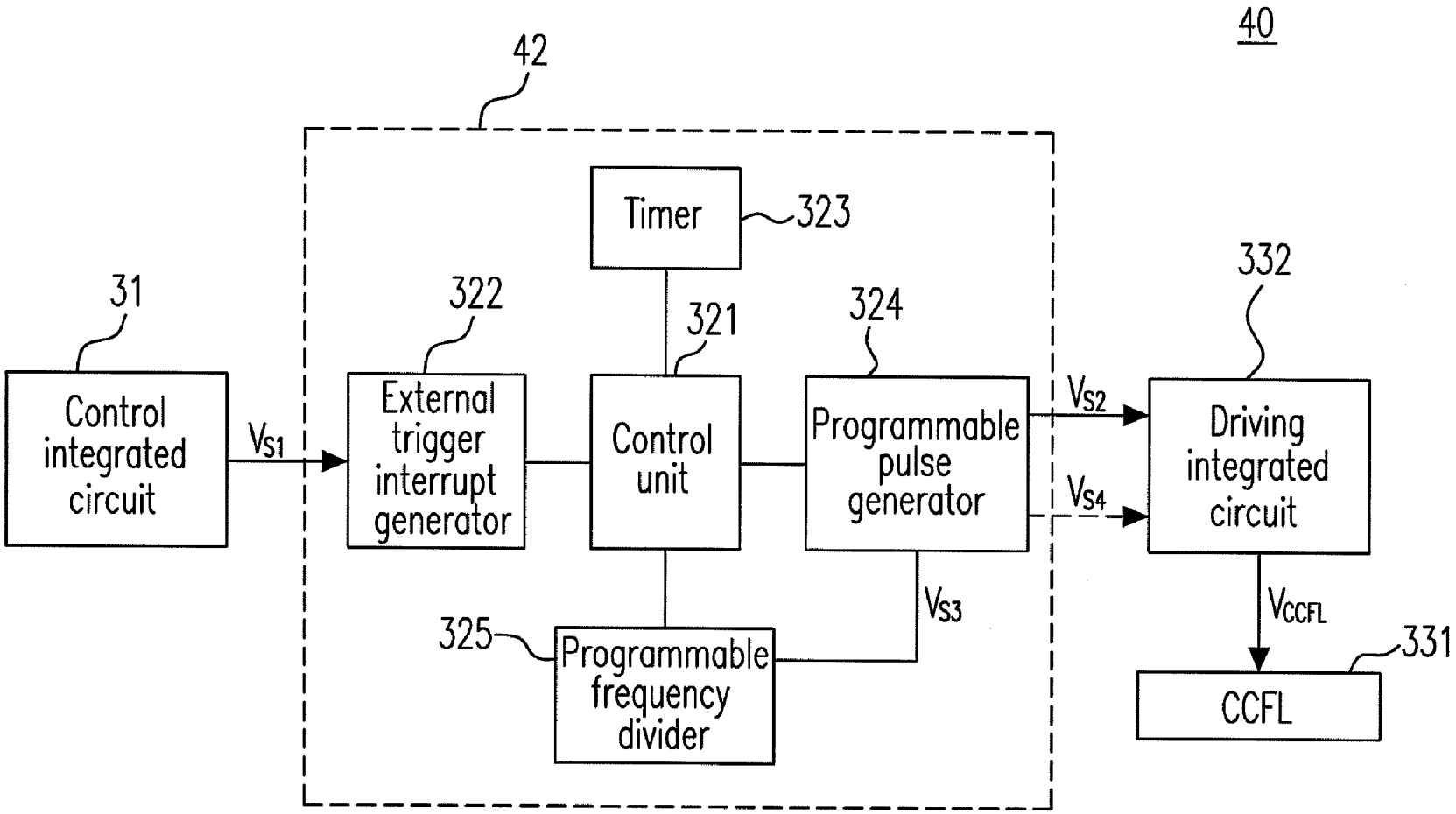
FIG. 4 is a schematic diagram showing an application system of a signal processing circuit according to the second embodiment of the present invention.

Please refer to FIG. 4, which is a schematic diagram showing an application system of a signal processing circuit according to the second embodiment of the present invention. The application system 40 in FIG. 4 is an expansion of the application system 30 in FIG. 3. As shown in FIG. 4, the application system 40 of the signal processing circuit 42 includes a control integrated circuit 31 of an LCD, the signal processing circuit 42, a CCFL 331, and a driving integrated circuit 332 of the CCFL 331.

The signal processing circuit 42 includes the external trigger interrupt generator 322, the timer 323, the programmable pulse generator 324, a programmable frequency divider 325, and the control unit 321. The programmable frequency divider 325 having a frequency divisor is coupled to the control unit 321 and produces a trigger signal $V_{S3}$ provided to the programmable pulse generator 324 according to the frequency divisor, wherein the frequency divisor is used to control a frequency of the trigger signal $V_{S3}$.

The control unit 321 utilizes the external trigger interrupt generator 322 and the timer 323 to analyze periods of a set of previous pulses just before the next expected pulse NPS1 of the synchronizing signal $V_{S1}$ for obtaining an average pulse width, a synchronizing period, and a synchronizing frequency, wherein the synchronizing period is a reciprocal of the synchronizing frequency. The synchronizing signal $V_{S2}$ has a second pulse TPS2 being a pulse right before a first pulse TPS1 corresponding to the next expected pulse NPS1, and an expected rising-edge time point T1 of the next expected pulse NPS1 is later or about later for the synchronizing period than a rising-edge time T3 of the second pulse TPS2; i.e., the expected rising-edge time point T1 is a summation or about a summation of the rising-edge time T3 and the synchronizing period. The expected rising-edge time point T1 can also be calculated from the average pulse width, the synchronizing period, and a rising-edge time or a falling-edge time of the last pulse NPS2 of the synchronizing signal $V_{S1}$. Besides, if the signal processing circuit 42 is a microcontroller, the operation of the control unit 321 may be performed by a firmware of the signal processing circuit 42.

Figure 5:
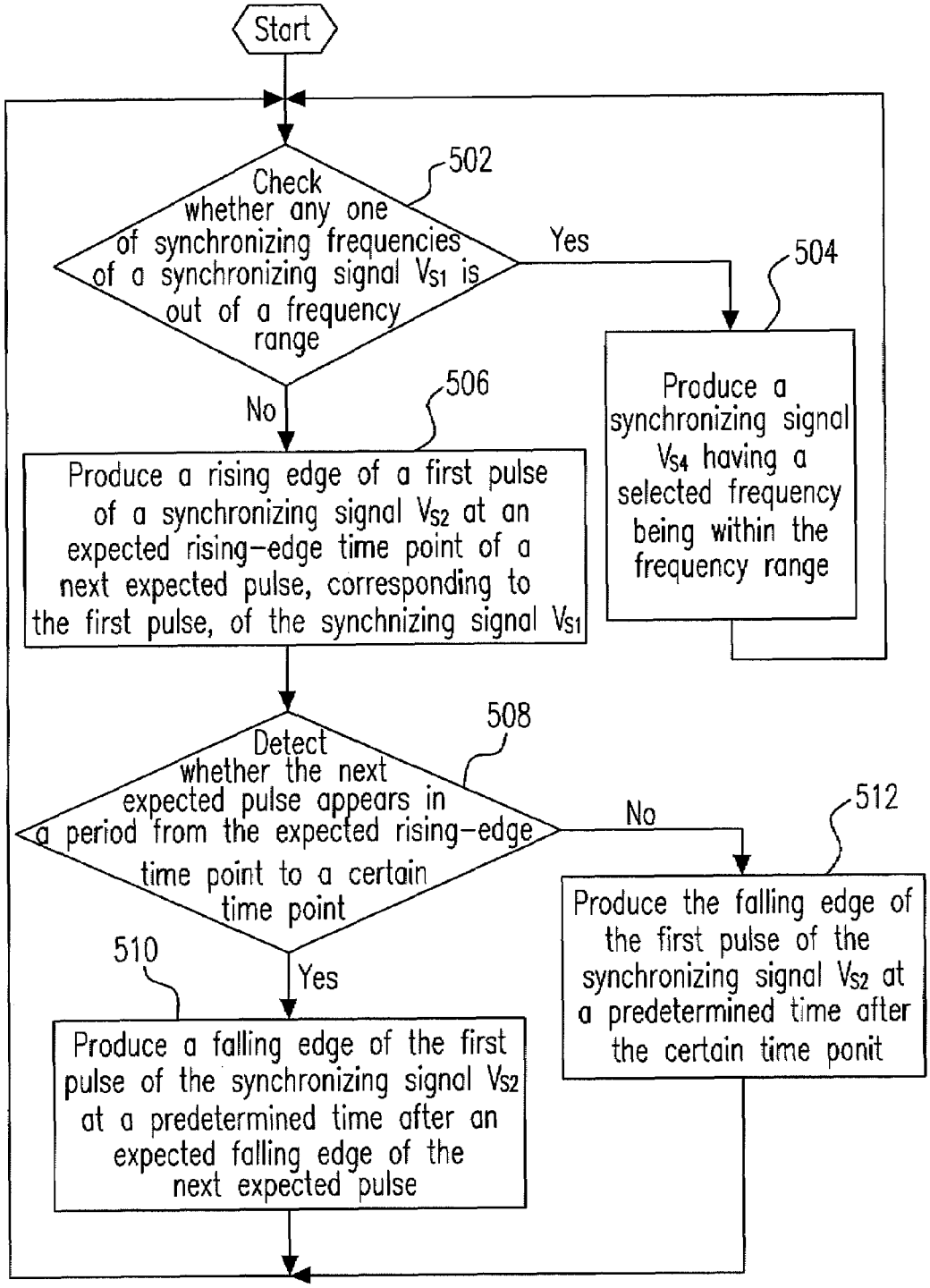
FIG. 5 is a schematic flow diagram showing a signal processing method according to the second embodiment of the present invention.

Afterward, a signal processing method applied to the circuit in FIG. 4 is described. Please refer to FIG. 5, which is a schematic flow diagram showing a signal processing method according to the second embodiment of the present invention, FIG. 3(*a*), and FIG. 3(*b*). In Step 502, the control unit 321 obtains synchronizing frequencies of the synchronizing signal $V_{S1}$ and checks whether any one of the synchronizing frequencies is out of a frequency range (e.g. 40 kHz~50 kHz).

In Step 504, when a synchronizing frequency, obtained by the control unit 321, of the synchronizing signal $V_{S1}$ is out of the frequency range, the synchronizing frequency of the synchronizing signal $V_{S1}$ is regarded as abnormal. Therefore, the control unit 321 controls the programmable frequency divider 325 for allowing the programmable frequency divider 325 to produce a trigger signal $V_{S3}$ having a selected frequency, wherein the selected frequency is within the frequency range (e.g. 40 kHz~50 kHz), the trigger signal $V_{S3}$ includes a series of pulses and is provided to the programmable pulse generator 324, and the duty ratio of the series of the pulses is 50% in general. The programmable pulse generator 324 produces a synchronizing signal $V_{S4}$ having the selected frequency according to the trigger signal $V_{S3}$, and the synchronizing signal $V_{S4}$ is provided to the driving integrated circuit 332 of the CCFL 331. Therein the control unit 321 controls pulse widths of the synchronizing signal $V_{S4}$ by setting the prescale value of the programmable pulse generator 324, and pulses of the synchronizing signal $V_{S4}$ may have a duty ratio of 50% or have adjustable pulse widths.

In Step 506, when the synchronizing frequency, obtained by the control unit 321, of the synchronizing signal $V_{S1}$ is within the frequency range, the control unit 321 utilizes the timer 323 and the programmable pulse generator 324 for allowing the programmable pulse generator 324 to produce a rising edge of a first pulse TPS1 of the synchronizing signal $V_{S2}$ at an expected rising-edge time point T1 of a next expected pulse NPS1 of the synchronizing signal $V_{S1}$, wherein the first pulse TPS1 corresponds to the next expected pulse NPS1.

In Step 508, the control unit 321 utilizes the external trigger interrupt generator 322 and the timer 323 to detect whether an expected falling edge of the next expected pulse NPS1 appears in a period from the expected rising-edge time point T1 to a certain time point T2. Therein the certain time point T2 is a half of the synchronizing period later than the expected rising-edge time point T1, or the certain time point T2 is a multiple of a half of the synchronizing period later than the expected rising-edge time point T1 and the multiple is about 1 in general.

In Step 510, when the expected falling edge of the next expected pulse NPS1 appears in the period from the expected rising-edge time point T1 to the certain time point T2, the control unit 321 utilizes the programmable pulse generator 324 to produce a falling edge of the first pulse TPS1 at a moment or a predetermined time after the expected falling edge of the next expected pulse NPS1.

In Step 512, when the expected falling edge of the next expected pulse NPS1 does not appear in the period from the expected rising-edge time point T1 to the certain time point T2, the control unit 321 utilizes the programmable pulse generator 324 to produce the falling edge of the first pulse TPS1 at a moment or a predetermined time after the certain time point T2. The control unit 321 controls the falling-edge time point of the first pulse TPS1 by adjusting the prescale adjustment value of the programmable pulse generator 324 for adjusting the pulse width of the first pulse TPS1. Therefore, the picture-field flicker phenomenon due to the lost pulse may be eliminated at the optimum.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A signal processing method, comprising steps of:

defining a frequency range;

providing a first synchronizing signal having a synchronizing frequency and a next expected pulse with an expected rising edge;

producing a second synchronizing signal having a selected frequency being within the frequency range when the synchronizing frequency of the first synchronizing signal is out of the frequency range;

producing a third synchronizing signal having a first pulse with a first rising edge when the synchronizing frequency is within the frequency range, wherein the first rising edge is produced at an expected time point at which the expected rising edge is expected to be produced;

detecting whether the next expected pulse appears in a period from the expected time point to a certain time point as a detecting result when the synchronizing frequency is within the frequency range; and producing a first falling edge of the first pulse based on the detecting result.

2. A signal processing method according to claim 1, further comprising a step of:

obtaining a synchronizing period and the synchronizing frequency by analyzing periods of a set of previous pulses just before the next expected pulse of the first synchronizing signal, wherein the synchronizing period is a reciprocal of the synchronizing frequency, the third synchronizing signal further has a second pulse with a second rising edge, the second pulse is a pulse right before the first pulse, and the expected time point is later for the synchronizing period than the time when the second rising edge is produced.

3. A signal processing method according to claim 1, further comprising steps of:

adjusting pulse widths of the second synchronizing signal when the synchronizing frequency of the first synchronizing signal is out of the frequency range; and adjusting a pulse width of the first pulse of the third synchronizing signal when the synchronizing frequency is within the frequency range.

4. A signal processing method according to claim 1, wherein a synchronizing period is a reciprocal of the synchronizing frequency, and the certain time point is a half of the synchronizing period later than the expected time point.

5. A signal processing method according to claim 1, wherein a synchronizing period is a reciprocal of the synchronizing frequency, and the certain time point is a multiple of a half of the synchronizing period later than the expected time point.

6. A signal processing method according to claim 1, wherein:

the first falling edge is produced after an expected falling edge of the next expected pulse is produced when the expected falling edge appears before the certain time point;

the first falling edge is produced after the certain time point when the expected falling edge does not appear before the certain time point; and the first pulse corresponds to the next expected pulse.

7. A signal processing method according to claim 1, wherein the first synchronizing signal is provided by a control integrated circuit of a liquid crystal display.

8. A signal processing method according to claim 1, wherein the second synchronizing signal is provided to a driving integrated circuit of a cold cathode fluorescent lamp (CCFL), the third synchronizing signal is provided to the driving integrated circuit of the CCFL, and one of the selected frequency and a frequency of the third synchronizing signal is used as a lighting frequency of the CCFL.

9. A signal processing method according to claim 1, wherein the second synchronizing signal is provided to a driving integrated circuit of a back light source including a light emitting diode (LED), and the third synchronizing signal is provided to the driving integrated circuit of the back light source including the LED.

10. A signal processing method according to claim 1, wherein:

the method is performed by a microcontroller;

the microcontroller at least includes a firmware, an external trigger interrupt generator, a programmable pulse generator and a timer, wherein the firmware controls the external trigger interrupt generator, the programmable pulse generator and the timer;

the firmware obtains the synchronizing frequency of the first synchronizing signal by using the external trigger interrupt generator and the timer, and by receiving the first synchronizing signal;

when the synchronizing frequency is out of the frequency range, the programmable pulse generator produces a trigger signal having the selected frequency for producing the second synchronizing signal;

when the synchronizing frequency is out of the frequency range, the firmware further sets a prescale adjustment value of the programmable pulse generator for controlling pulse widths of the second synchronizing signal;

when the synchronizing frequency is within the frequency range, the firmware utilizes the timer and the programmable pulse generator for allowing the programmable pulse generator to produce the first rising edge; and when the synchronizing frequency is within the frequency range, the firmware utilizes the detecting result, the timer, and the programmable pulse generator for allowing the programmable pulse generator to produce the first falling edge.

11. A signal processing method according to claim 1, wherein:

the method is performed by a microcontroller;

the microcontroller at least includes a firmware, an external trigger interrupt generator, a programmable frequency divider, a programmable pulse generator and a timer, wherein the firmware controls the external trigger interrupt generator, the programmable frequency divider, the programmable pulse generator and the timer;

the firmware obtains the synchronizing frequency of the first synchronizing signal by using the external trigger interrupt generator and the timer, and by receiving the first synchronizing signal;

when the synchronizing frequency is out of the frequency range, the programmable frequency divider produces a trigger signal having the selected frequency, and the programmable pulse generator receives the trigger signal for producing the second synchronizing signal;

when the synchronizing frequency is out of the frequency range, the firmware further sets a prescale adjustment value of the programmable pulse generator for controlling pulse widths of the second synchronizing signal;

when the synchronizing frequency is within the frequency range, the firmware utilizes the timer and the programmable pulse generator for allowing the programmable pulse generator to produce the first rising edge; and when the synchronizing frequency is within the frequency range, the firmware utilizes the detecting result, the timer, and the programmable pulse generator for allowing the programmable pulse generator to produce the first falling edge.

12. A signal processing method according to claim 1, wherein the method is performed by an application specific integrated circuit.

13. A signal processing circuit, comprising:

an external trigger interrupt generator receiving a first synchronizing signal, and detecting a pulse edge of the first synchronizing signal for determining whether the first synchronizing signal appears, wherein the first synchronizing signal has a next expected pulse with an expected rising edge;

a timer;

a programmable pulse generator having a prescale adjustment value, and producing a second synchronizing signal having a first pulse with a first rising edge according to the prescale adjustment value; and a control unit coupled to the external trigger interrupt generator, the timer and the programmable pulse generator, wherein the control unit utilizes the external trigger interrupt generator and the timer for allowing the programmable pulse generator to produce the first rising edge at an expected time point at which the expected rising edge is expected to be produced.

14. A signal processing circuit according to claim 13, wherein the first pulse corresponds to the next expected pulse, the control unit utilizes the external trigger interrupt generator and the timer to detect whether the next expected pulse appears in a period from the expected time point to a certain time point as a detecting result, and the programmable pulse generator produces a falling edge of the first pulse based on the detecting result.

15. A signal processing circuit according to claim 13, further comprising a programmable frequency divider having a frequency divisor, coupled to the control unit, and producing a trigger signal provided to the programmable pulse generator according to the frequency divisor, wherein:

the control unit obtains a synchronizing frequency of the first synchronizing signal by the external trigger interrupt generator and the timer;

when the synchronizing frequency is out of a frequency range, the control unit controls the programmable frequency divider to produce a trigger signal having a selected frequency being within the frequency range; and the control unit controls the programmable pulse generator to receive the trigger signal and to produce a third synchronizing signal having the selected frequency.

16. A signal processing circuit according to claim 13, being one of a microcontroller and an application specific integrated circuit.

17. A signal processing circuit according to claim 13, wherein the first synchronizing signal is provided by a control integrated circuit of a liquid crystal display.

18. A signal processing circuit according to claim 13, wherein the second synchronizing signal is provided to a driving integrated circuit of a CCFL, and a frequency of the second synchronizing signal is used as a lighting frequency of the CCFL.

19. A signal processing circuit according to claim 13, wherein the second synchronizing signal is provided to a driving integrated circuit of a back light source of an LED.

20. A signal processing method, comprising steps of:

defining a frequency range;

providing a first synchronizing signal having a next expected pulse, wherein the next expected pulse has an expected rising edge which is expected to be produced at an expected time point;

producing a second synchronizing signal having a first pulse with a rising edge produced at the expected time point;

detecting whether the next expected pulse appears in a period from the expected time point to a certain time point as a detecting result; and producing a falling edge of the first pulse based on the detecting result, wherein a third synchronizing signal having a selected frequency within the frequency range is produced when a synchronizing frequency of the first synchronizing signal is out of the frequency range.

* * * * *